US010237935B2

(12) United States Patent
Seki

(10) Patent No.: US 10,237,935 B2
(45) Date of Patent: Mar. 19, 2019

(54) EMISSION CONTROL DEVICE, LIGHT-EMITTING MODULE, LIGHT-EMITTING UNIT, AND LIGHTING FIXTURE

(71) Applicant: Panasonic Intellectual Property Management Co., Ltd., Osaka (JP)

(72) Inventor: Keisuke Seki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/596,478

(22) Filed: May 16, 2017

(65) Prior Publication Data

US 2017/0339759 A1 Nov. 23, 2017

(30) Foreign Application Priority Data

May 20, 2016 (JP) ..... 2016-101967

(51) Int. Cl.

| | |
|---|---|
| ***H05B 37/02*** | (2006.01) |
| ***H05B 33/08*** | (2006.01) |
| *F21V 19/00* | (2006.01) |
| *F21Y 115/10* | (2016.01) |
| *F21S 8/02* | (2006.01) |

(52) U.S. Cl.

CPC ..... *H05B 33/0827* (2013.01); *H05B 33/0803* (2013.01); *H05B 33/0809* (2013.01); *H05B 33/0866* (2013.01); *F21S 8/026* (2013.01); *F21V 19/003* (2013.01); *F21Y 2115/10* (2016.08)

(58) Field of Classification Search

CPC ..... H05B 33/0815; H05B 33/0827; H05B 33/0845

USPC ..... 315/192

See application file for complete search history.

(56) References Cited

U.S. PATENT DOCUMENTS

| | | | | |
|---|---|---|---|---|
| 9,544,960 | B2 * | 1/2017 | Huynh | H05B 33/083 |
| 2009/0230874 | A1 * | 9/2009 | Zhao | H05B 33/0827 315/192 |
| 2009/0296384 | A1 * | 12/2009 | Van De Ven | H05B 33/0803 362/231 |
| 2013/0009561 | A1 * | 1/2013 | Briggs | G01R 19/0092 315/210 |

(Continued)

FOREIGN PATENT DOCUMENTS

| | | |
|---|---|---|
| JP | 2010-183729 A | 8/2010 |
| JP | 2011-009077 A | 1/2011 |

(Continued)

*Primary Examiner* — Tung X Le

(74) *Attorney, Agent, or Firm* — Renner, Otto, Boisselle & Sklar, LLP

(57) ABSTRACT

An emission control device includes: a switching circuit for switching which light-emitting element or light-emitting elements from among a plurality of light-emitting elements is supplied with current; a detection circuit which detects current or voltage supplied from a DC-power supply circuit; and a control circuit which controls the switching circuit to switch which of the light-emitting element or light-emitting elements from among the plurality of light-emitting elements is supplied with the current when a power switch is turned from on to off and back to on within a predefined period and the current or the voltage detected by the detection circuit is less than when the power switch is on.

6 Claims, 14 Drawing Sheets

(56) References Cited

U.S. PATENT DOCUMENTS

| | | | | |
|---|---|---|---|---|
| 2013/0278145 | A1* | 10/2013 | Lin | H05B 33/0851 315/122 |
| 2014/0211192 | A1* | 7/2014 | Grootjans | H05B 33/0818 356/5.01 |
| 2015/0002032 | A1* | 1/2015 | Pereira | H05B 33/0815 315/186 |
| 2015/0173143 | A1* | 6/2015 | Zhang | H05B 33/0815 315/185 R |
| 2016/0014861 | A1* | 1/2016 | Zhu | H05B 33/0887 315/223 |

FOREIGN PATENT DOCUMENTS

| | | | |
|---|---|---|---|
| JP | 2012-199009 | A | 10/2012 |
| JP | 5420106 | B2 | 11/2013 |
| JP | 2014-007164 | A | 1/2014 |
| JP | 2014-017140 | A | 1/2014 |

* cited by examiner

EMISSION CONTROL DEVICE, LIGHT-EMITTING MODULE, LIGHT-EMITTING UNIT, AND LIGHTING FIXTURE

CROSS REFERENCE TO RELATED APPLICATION

This application claims the benefit of priority of Japanese Patent Application Number 2016-101967 filed on May 20, 2016, the entire content of which is hereby incorporated by reference.

1. TECHNICAL FIELD

The present disclosure relates to an emission control device, a light-emitting module, a light-emitting unit, and a lighting fixture.

2. DESCRIPTION OF THE RELATED ART

For example, a technology is known which consecutively switches a power switch, such as a wall switch, between on and off to switch a light-emitting element to be caused to emit light (for example, see PTL 1: Japanese Patent No. 5420106).

SUMMARY

According to the technology disclosed in PTL 1, on and off of the power switch is detected by detecting voltage before being input to a DC-power supply circuit. A problem with this case is that the DC-power supply circuit needs to be changed and a general-purpose DC-power supply circuit thus cannot be employed. Specifically, a detection circuit for detecting the voltage mentioned above is additionally required. Moreover, a dedicated IC or microcomputer is required. Since the DC-power supply circuit needs to be changed, the development effort increases as well.

Thus, an object of the present disclosure is to provide an emission control device, a light-emitting module, a light-emitting unit, or a lighting fixture which detects consecutive switching of a power switch, without changing a DC-power supply circuit.

An emission control device according to one aspect of the present disclosure is an emission control device configured to be connected to a DC-power supply circuit mounted on a first substrate, and for supplying current from the DC-power supply circuit to a plurality of light-emitting elements when a power switch connected to the DC-power supply circuit is turned on, the emission control device including: a second substrate different from the first substrate, and the following mounted thereon: a switching circuit for which light-emitting element from among the plurality of light-emitting elements is supplied with the current; a detection circuit which detects current or voltage supplied from the DC-power supply circuit; and a control circuit which controls the switching circuit to switch which of the light-emitting element or light-emitting elements from among the plurality of light-emitting elements is supplied with the current when the power switch is turned from on to off and back to on within a predefined period and the current or the voltage detected by the detection circuit is less than when the power switch is on.

The present disclosure provides an emission control device, a light-emitting module, a light-emitting unit, or a lighting fixture which detects consecutive switching of the power switch, without changing the DC-power supply circuit.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, embodiments according to the present disclosure are described with reference to the accompanying drawings. The embodiments described below are each merely one specific example of the present disclosure. Thus, values, shapes, materials, components, and arrangement and connection between the components shown in the following embodiments are merely by way of illustration and not intended to limit the present disclosure. Therefore, among the components in the embodiments below, components not recited in any one of the independent claims defining the most generic part of the inventive concept of the present disclosure are described as arbitrary components.

The figures are schematic views and do not necessarily illustrate the present disclosure precisely. In the figures, the same reference sign is used to refer to substantially the same configuration, and duplicate description is omitted or simplified.

Embodiment 1

In the present embodiment, basic configurations of a lighting fixture and a lighting device according to the present disclosure are described. Implementations of the lighting fixture and the lighting device according to the present disclosure are described in Embodiment 2 below.

[Configuration of Lighting Fixture]

Figure 1:
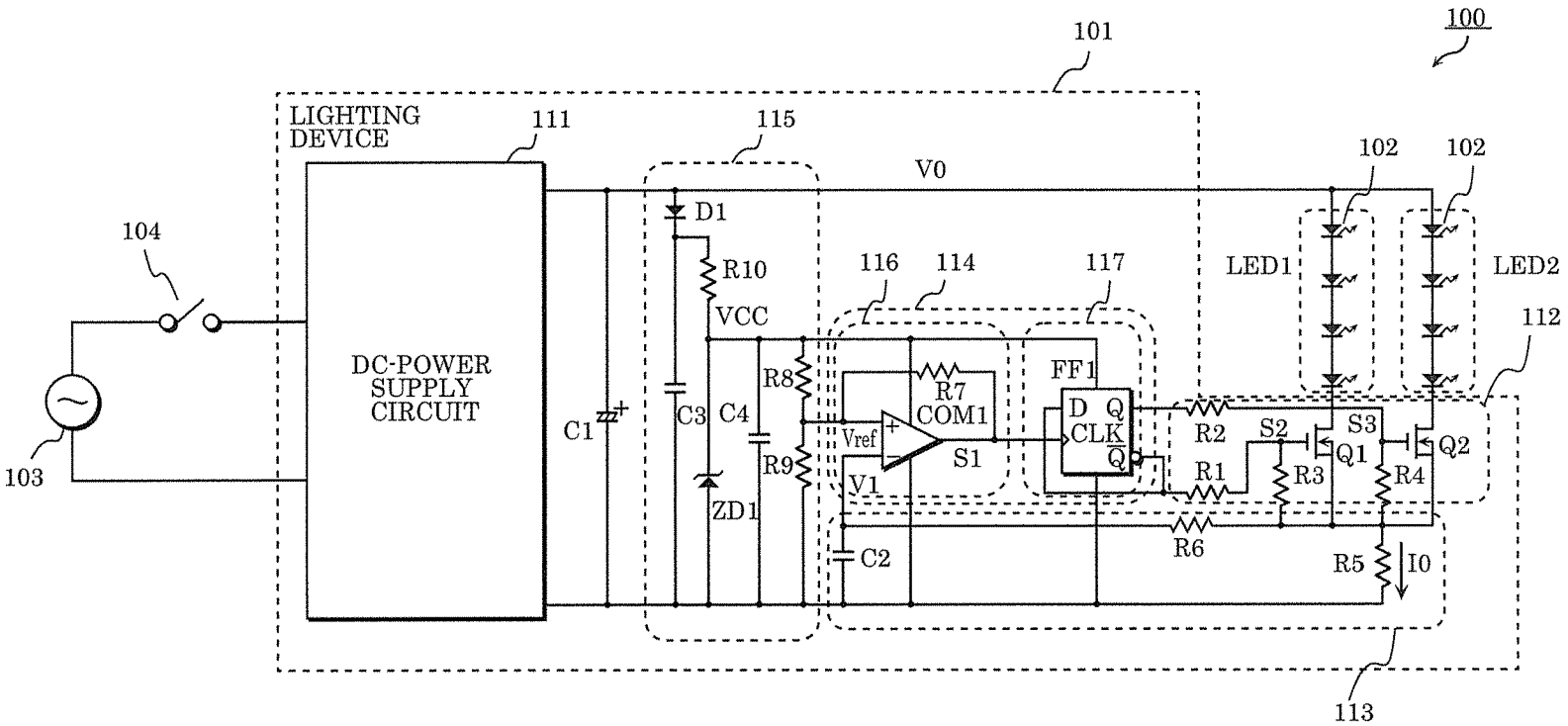
FIG. 1 is a diagram showing a configuration example of a lighting fixture according to Embodiment 1 of the present disclosure.

Initially, a configuration of lighting fixture 100 according to the present embodiment is described. FIG. 1 is a diagram illustrating a configuration of lighting fixture 100 according to the present embodiment. As illustrated in FIG. 1, lighting fixture 100 includes lighting device 101 and light-emitting elements 102.

Lighting device 101 turns on light-emitting elements 102, using power from mains supply 103. Power switch 104, such as a wall switch, is connected between lighting device 101 and mains supply 103. In other words, supply of power from mains supply 103 to lighting device 101 is switched between on and off, based upon on and off of power switch 104, thereby switching the supply of power to light-emitting elements 102 between on and off.

Lighting device 101 includes DC-power supply circuit 111, switching circuit 112, detection circuit 113, control circuit 114, controlled power supply circuit 115, and capacitor C1.

DC-power supply circuit 111 converts AC power supplied from mains supply 103 into DC power and generates constant current using the DC power. DC-power supply circuit 111, for example, includes an AC-to-DC converter and a DC-to-DC converter. The constant current generated by DC-power supply circuit 111 is supplied to light-emitting elements 102.

Capacitor C1 is a capacitor element connected to an output terminal of DC-power supply circuit 111 and used to smooth the constant current generated by DC-power supply circuit 111. While capacitor C1 is provided outside DC-power supply circuit 111 in FIG. 1, it should be noted that capacitor C1 may be included in DC-power supply circuit 111.

Light-emitting elements 102 are solid-state light-emitting elements, for example, light-emitting diodes (LEDs). Light-emitting elements 102 are arranged in light-emitting groups LED1 and LED2. For example, light-emitting element 102 belonging to light-emitting group LED1 and light-emitting element 102 belonging to light-emitting group LED2 emit light having different emission colors (color temperatures). Light-emitting elements 102 for each light-emitting group are connected in series.

Switching circuit 112 switches a light-emitting group to be supplied with current among light-emitting groups LED1 and LED2. In other words, switching circuit 112 switches which light-emitting element(s) 102 from among light-emitting elements 102 is supplied with current. Switching circuit 112 includes switching elements Q1 and Q2 and resistors R1, R2, R3, and R4.

Switching elements Q1 and Q2 are for switching which light-emitting group from among light-emitting groups LED1 and LED2 is supplied with current. Switching elements Q1 and Q2 are, for example, MOSFETs. Switching element Q1 is connected to light-emitting group LED1 in series. Switching element Q2 is connected to light-emitting group LED2 in series. Note that resistors R1 and R2 are for inhibiting an instant high current, and resistors R3 and R4 are for fixing the gate voltages of switching elements Q1 and Q2 to the GND level, as a countermeasure for stray capacitance.

Detection circuit 113 is for detecting current JO supplied from DC-power supply circuit 111. Stated differently, detection circuit 113 detects current JO through light-emitting elements 102. Detection circuit 113 includes resistors R5 and R6 and capacitor C2. Detection circuit 113 converts detection current JO through resistor R5 into detection voltage V1. Current JO through resistor R5 corresponds to current through light-emitting elements 102. Note that resistor R6 and capacitor C2 function as a low pass filter and prevent unexpected switching operation caused by an event of an instant power failure or extraneous noise in a short time.

If power switch 104 is temporarily turned off and current I0 detected by detection circuit 113 is less than a value (for example, a predetermined reference value) that is detected when power switch 104 is on, control circuit 114 controls switching circuit 112 to switch which light-emitting element 102 from among light-emitting elements 102 is supplied with current. Specifically, control circuit 114 switches which of the light-emitting element or light-emitting elements from among light-emitting elements 102 is supplied with the current on a group-by-group basis among light-emitting groups LED1 and LED2. The expression "power switch 104 is temporarily turned off," as used herein, refers to a fact that power switch 104 changes from on-state to off-state, and back to on-state within a predefined period. The predefined period is, for example, about 0.1 second to about 3 seconds. Preferably, the predefined period is about 0.1 second to about 2 seconds. More preferably, the predefined period is about 0.1 second to about 1 second. Control circuit 114 includes comparison circuit 116 and sequential circuit 117.

Comparison circuit 116 compares detection voltage V1 with a predetermined reference voltage VRef and outputs comparison result signal S1 indicating a result of the comparison. For example, comparison circuit 116 outputs low signal S1 in normal operation (when detection current I0 is higher than the reference value), and outputs high signal S1 when detection current I0 is lower than the reference value. Comparison circuit 116 includes comparator COM1. Comparator COM1 compares detection voltage V1 with reference voltage VRef and outputs signal S1 indicating a result of the comparison. Note that hysteresis property of comparison circuit 116 is implemented by resistor R7.

Sequential circuit 117 inverts logic values of output signals S2 and S3, based on a change in comparison result signal S1. Sequential circuit 117 includes flip flop FF1. Specifically, sequential circuit 117 inverts logic values of output signals S2 and S3 at a rising edge of comparison result signal S1. Note that output signal S2 is an inverted signal of output signal S3. Output signal S2 is supplied to the gate terminal of switching element Q1. Output signal S3 is supplied to the gate terminal of switching element Q2.

Controlled power supply circuit 115 generates, from voltage V0, reference voltage VRef and power supply voltage VCC that is for use as power supply voltage for switching circuit 112, detection circuit 113, and control circuit 114. Controlled power supply circuit 115 includes diode D1, Zener diode ZD1, resistors R8, R9, and R10, and capacitors C3 and C4. Controlled power supply circuit 115 outputs, as power supply voltage VCC, a voltage corresponding to breakdown voltage of Zener diode ZD1. Reference voltage VRef is generated by dividing power supply voltage VCC by resistors R8 and R9.

[Operation of Lighting Fixture]

In the following, an operation of lighting fixture 100 according to the present embodiment is described. According to lighting fixture 100 of the present embodiment, as a user switches power switch 104 from on-state (on) to off-state (off) and back to on-state (on) in a short time, a light-emitting group to be turned on switches with another light-emitting group. In other words, the user can switch emission colors produced by lighting fixture 100 by operating power switch 104 twice in quick succession.

Figure 2:
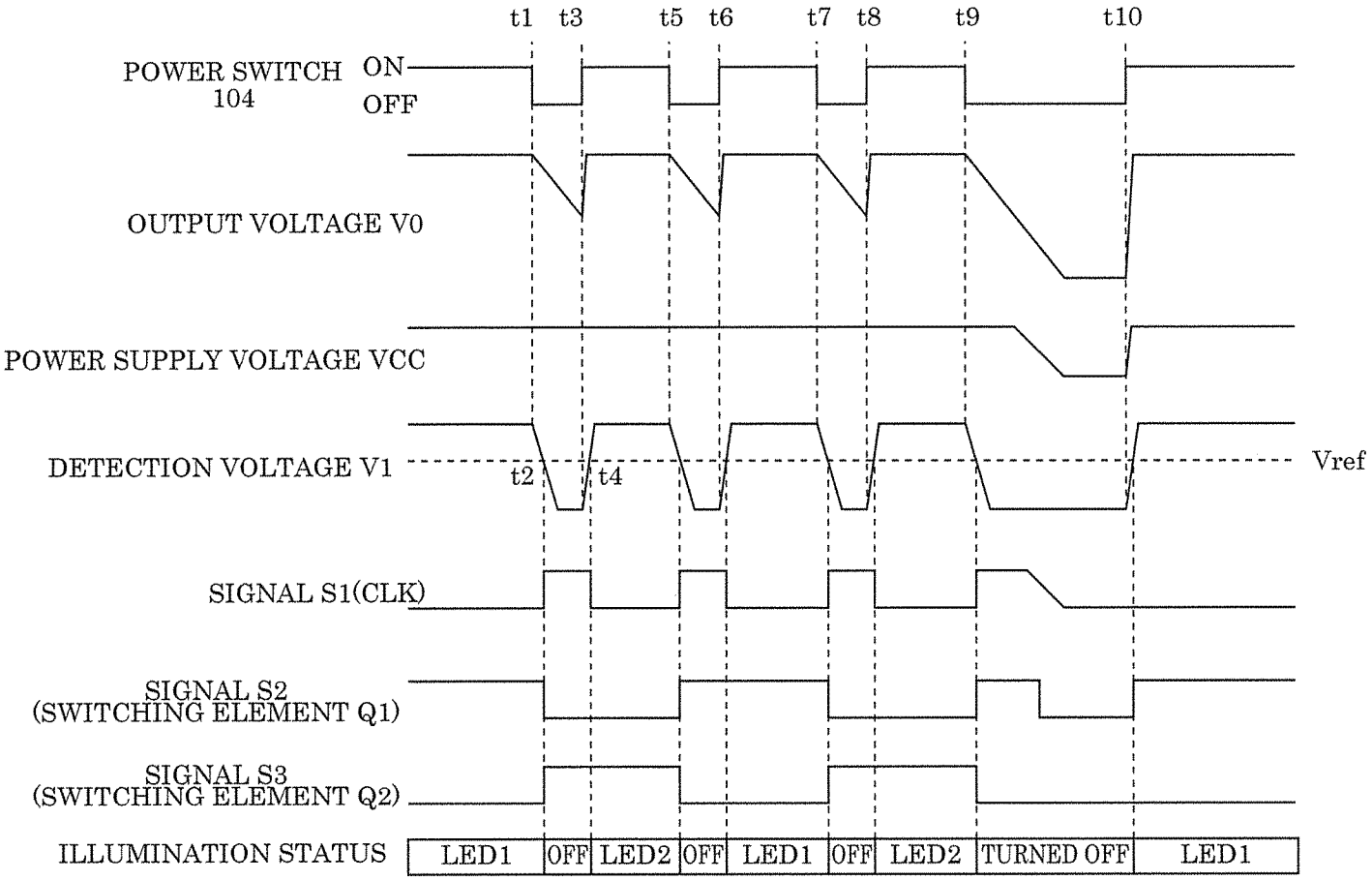
FIG. 2 is a timing diagram illustrating an operation of the lighting fixture according to Embodiment 1.

FIG. 2 is a timing diagram illustrating an operation of lighting fixture 100. In this example, signal S2 is high and signal S3 is low before time t1. For this reason, light-emitting group LED1 is on and light-emitting group LED2 is off. In this state, power switch 104 is turned off at time t1 and turned back on at time t3.

As power switch 104 is turned off at time t1, output of DC-power supply circuit 111 halts and voltage V0 at capacitor C1 gradually decreases. Along with the reduction of output voltage V0, current I0 through light-emitting elements 102 decreases as well, which reduces detection voltage V1. Note that the reduction of output voltage V0 is slight at this stage and thus power supply voltage VCC does not decrease. Thus, control circuit 114 operates as usual. In other words, control circuit 114 operates using residual charge at capacitors C1 and C3 once power switch 104 is turned off.

If detection voltage V1 is less than reference voltage VRef at time t2, signal S1 changes from low to high. This changes signal S2 from high to low, and signal S3 from low to high, thereby switching the light-emitting group to be supplied with current from light-emitting group LED1 to light-emitting group LED2.

Moreover, as power switch 104 is turned back on at time t3, DC-power supply circuit 111 starts outputting constant current and voltage V0 increases. This also increases current I0 through light-emitting elements 102, which increases detection voltage V1 as well.

As detection voltage V1 increases greater than reference voltage VRef at time t4, signal S1 changes from high to low, but flip flop FF1 maintains its state and output signals S2 and S3 remain unchanged.

As such, a light-emitting group to be turned on is switched by the user switching power switch 104 from on to off and back to on in a short time.

The same operation is carried out at time t5 to time t6 as well to switch the light-emitting group which is supplied with current from light-emitting group LED2 to light-emitting group LED1. Moreover, the operation at time t7 to t8 switches the light-emitting group which is supplied with current from light-emitting group LED1 to light-emitting group LED2.

Next, power switch 104 is turned off at time t9. In this case, the off-period during which power switch 104 is off is sufficiently long and voltage V0 thus decreases along with which power supply voltage VCC decreases. This ends up with control circuit 114 turning into inactive. Thus, control circuit 114 is reset when power switch 104 is turned on at time t10. This turns on a predetermined light-emitting group (light-emitting group LED1 in this example).

As such, if an off-period of power switch 104 is sufficiently long, control circuit 114 is reset and the predetermined light-emitting group is selected. Owing to this, when lighting fixtures 100 are connected to one power switch 104 and different light-emitting groups are selected in lighting fixtures 100, the user can cause the same light-emitting group to be selected in lighting fixtures 100 by turning off power switch 104 for a predetermined time or longer.

[Variation 1]

Figure 3:
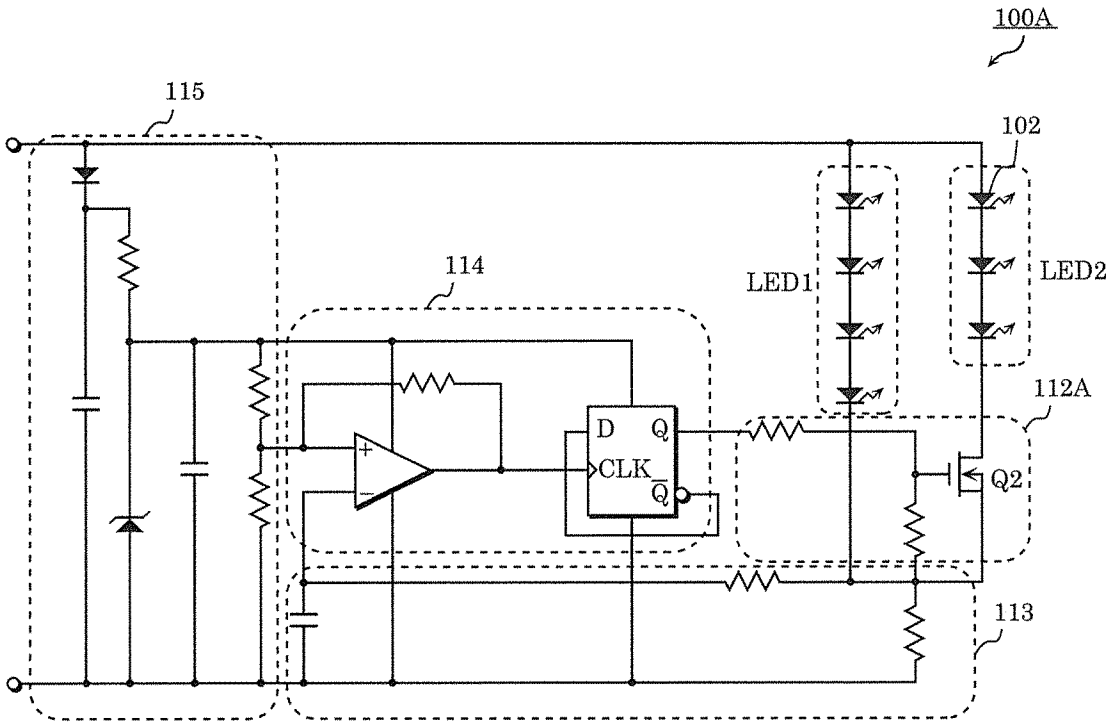
FIG. 3 is a diagram showing a configuration example of a lighting fixture according to Variation 1 of Embodiment 1.

FIG. 3 is a diagram showing a configuration example of lighting fixture 100A according to Variation 1 of the present embodiment. In lighting fixture 100A illustrated in FIG. 3, a total number of light-emitting elements 102 connected in series in light-emitting group LED1 is greater than a total number of light-emitting elements 102 connected in series in light-emitting group LED2. Moreover, switching circuit 112A includes only switching element Q2 that is connected to light-emitting group LED2 in series. In other words, no switching element is connected to light-emitting group LED1 in series.

In this case, during an on-period of switching element Q2, current flows through only light-emitting group LED2 that includes a less number of light-emitting elements 102 connected in series, that is, a smaller forward voltage than light-emitting group LED1, among light-emitting groups LED1 and LED2. On the other hand, during an off-period of switching element Q2, current flows through light-emitting group LED1 only.

Here, light-emitting groups LED1 and LED2 are different in luminous flux (brightness) since the number of light-emitting elements 102 included in light-emitting groups LED1 and LED2 are different. Thus, step-dimming can be achieved by causing light-emitting groups LED1 and LED2 to produce the same emission color. Moreover, emission color switching and step-dimming are achieved by causing light-emitting groups LED1 and LED2 to produce different emission colors.

According to this configuration, the total number of switching elements included in the configuration illustrated in FIG. 1 is reduced, thereby achieving cost reduction.

[Variation 2]

Figure 4:
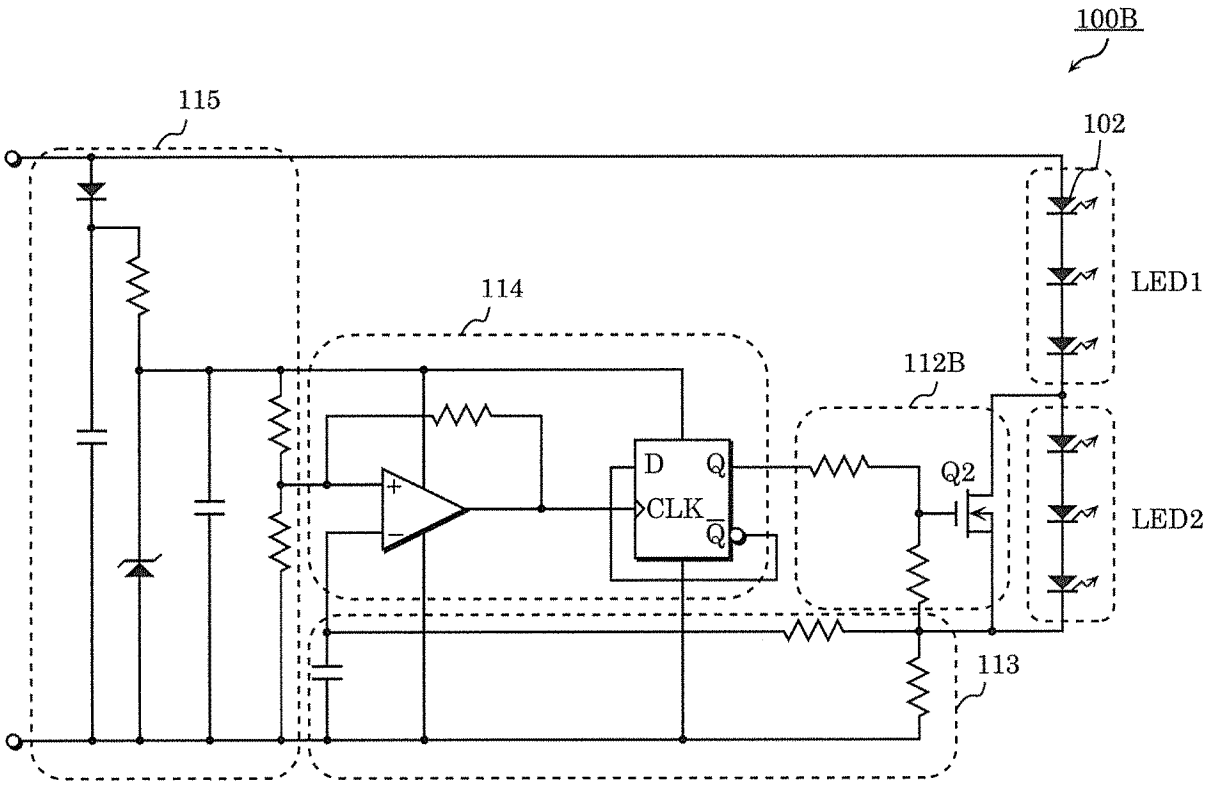
FIG. 4 is a diagram showing a configuration example of a lighting fixture according to Variation 2 of Embodiment 1.

FIG. 4 is a diagram showing a configuration example of lighting fixture 100B according to Variation 2 of the present embodiment. In lighting fixture 100B illustrated in FIG. 4, light-emitting group LED1 and light-emitting group LED2 are connected in series. Moreover, switching circuit 112B includes only switching element Q2 that is connected to light-emitting group LED2 in parallel.

In this case, current flows through both light-emitting groups LED1 and LED2 during an off-period of switching element Q2. On the other hand, current flows through light-emitting group LED1 only, during an on-period of switching element Q2.

Thus, step-dimming is achieved by causing light-emitting groups LED1 and LED2 to produce the same emission color.

[Variation 3]

Figure 5:
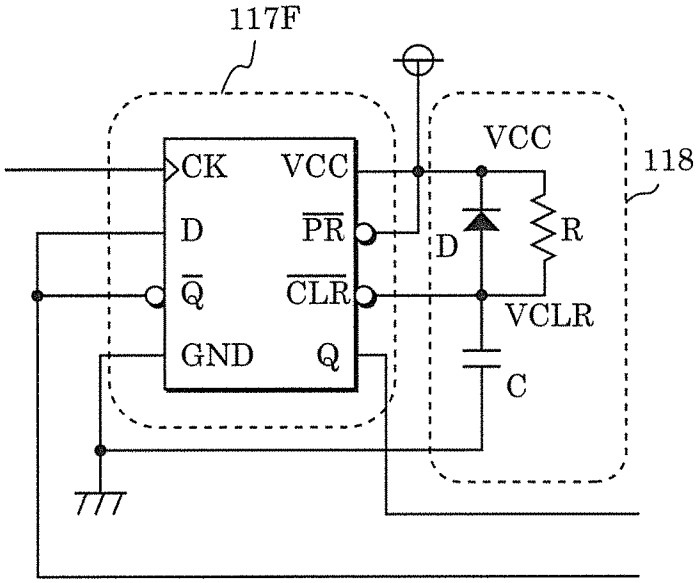
FIG. 5 is a diagram showing a configuration example of a reset circuit according to Variation 3 of Embodiment 1.

Any of the lighting fixtures described above may include a power-on reset circuit (or power-on preset circuit) for reliably resetting the sequential circuit. FIG. 5 is a diagram showing configuration examples of sequential circuit 117F and reset circuit 118 according to Variation 3 of the present embodiment. Sequential circuit 117C is, for example, sequential circuit 117 described above.

Reset circuit 118 includes resistor R, diode D, and capacitor C. Resistor R and diode D are connected between a VCC terminal and a CLR bar terminal of sequential circuit 117F. Capacitor C is connected to the CLR bar terminal.

Figure 6:
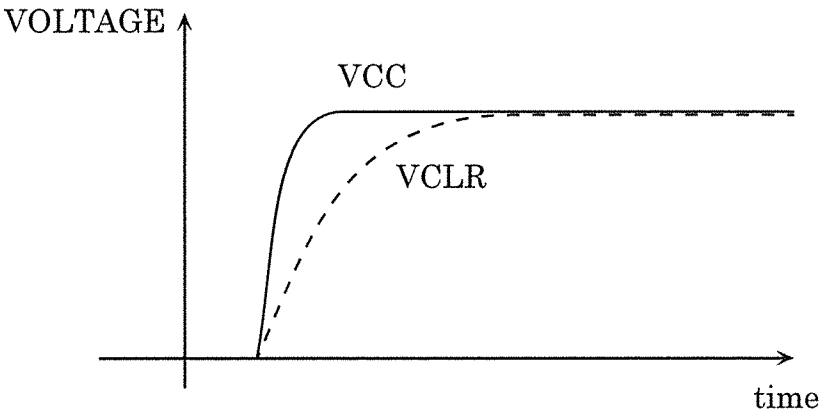
FIG. 6 is a diagram illustrating an operation of the reset circuit according to Variation 3 of Embodiment 1.

FIG. 6 is a diagram illustrating an operation of reset circuit 118. Voltage VCLR input to the CLR bar terminal rises later than voltage VCC from the VCC terminal due to effects of resistor R and capacitor C, as illustrated in FIG. 6. This determines the CLR bar terminal to be low at power-up, thereby causing sequential circuit 117F to be reset.

Embodiment 2

In the present embodiment, implementations of the lighting device and the lighting fixture set forth above are described. In the following, an implementation of lighting fixture 100 illustrated in FIG. 1 is described. However, the same implementation is also applicable to the lighting fixtures described in the above Variations.

[Light-Emitting Module]

Figure 7:
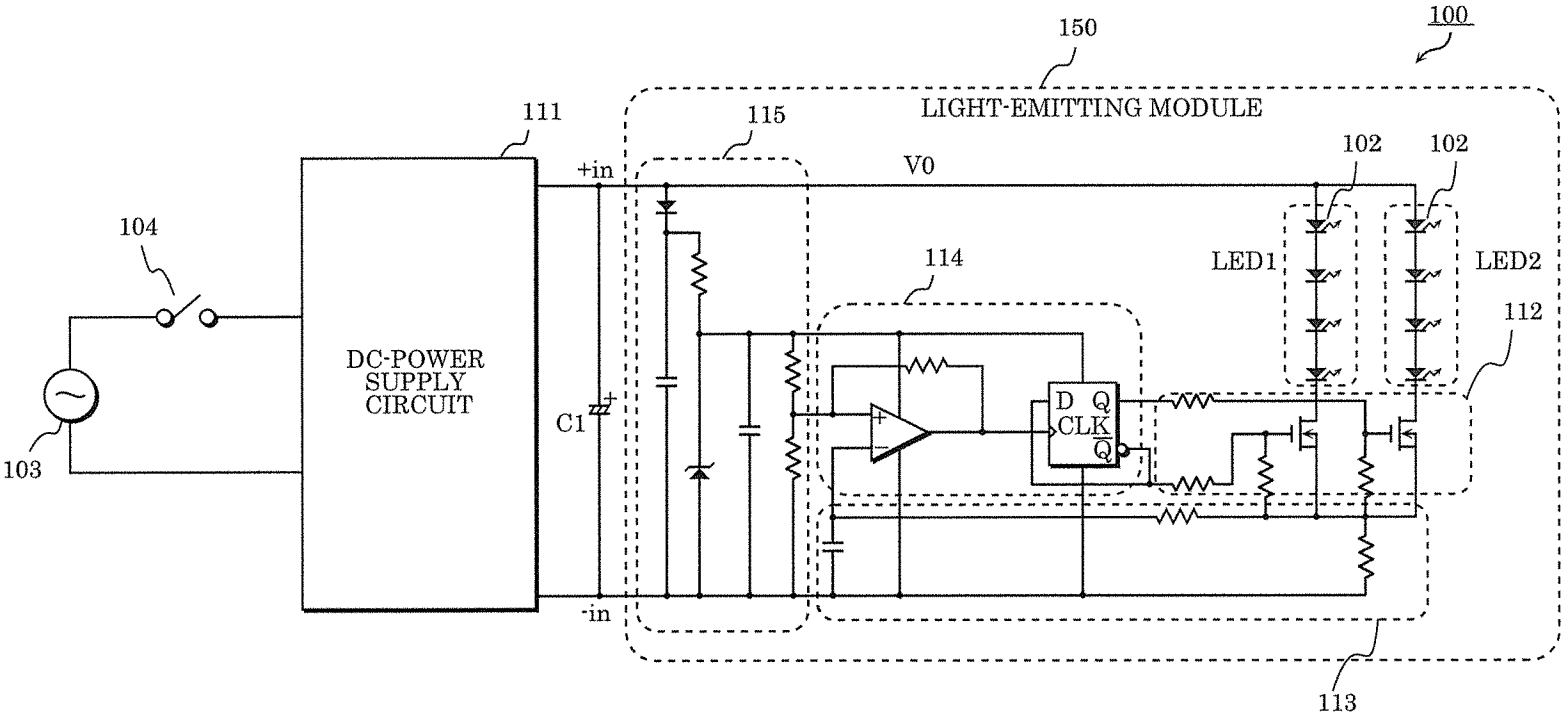
FIG. 7 is a diagram showing a configuration of a light-emitting module according to Embodiment 2 of the present disclosure.

FIG. 7 is a diagram showing a configuration example of light-emitting module 150 according to the present embodiment. As illustrated in FIG. 7, light-emitting module 150 includes light-emitting elements 102, switching circuit 112, detection circuit 113, control circuit 114, and controlled power supply circuit 115 that are described above. These components are mounted on one substrate 153 that is different from a substrate on which DC-power supply circuit 111 is mounted.

Light-emitting module 150 is connected to DC-power supply circuit 111. Light-emitting module 150 has two input terminals (+in, −in) to which power (current and voltage) is supplied from DC-power supply circuit 111.

Figure 8:
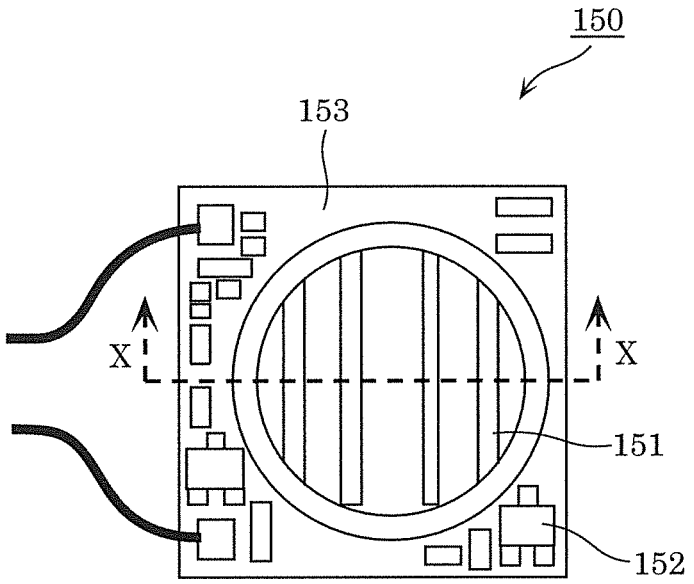
FIG. 8 is a plan view of an appearance of the light-emitting module according to Embodiment 2.
Figure 9:
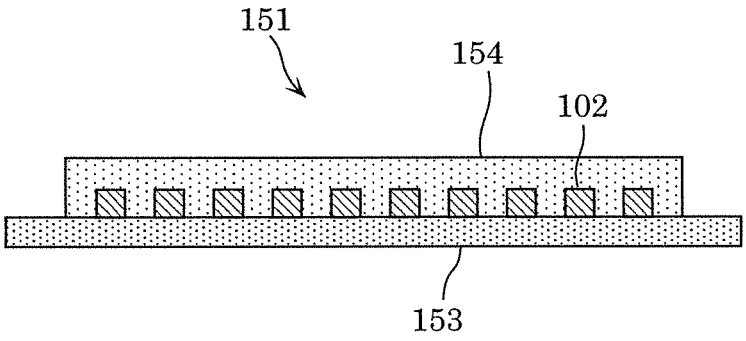
FIG. 9 is a cross-sectional view of the light-emitting module according to Embodiment 2.

FIG. 8 is a plan view of light-emitting module 150 configured as a COB (chip on board) LED module. FIG. 9 is a cross-sectional view of light emitter 151 taken along X-X plane in FIG. 8. As illustrated in FIGS. 8 and 9, light-emitting module 150 includes light emitter 151 and electronic circuit component 152 that are mounted on one substrate 153. Light emitter 151 includes light-emitting elements 102 mounted on substrate 153, such as LEDs, and phosphor 154 which covers light-emitting elements 102.

Electronic circuit component 152 implements a switching control circuit which includes switching circuit 112, detection circuit 113, control circuit 114, and controlled power supply circuit 115.

Modularizing light-emitting elements 102 and the switching control circuit as such achieves size reduction of the circuit portion that includes light-emitting elements 102.

Figure 10:
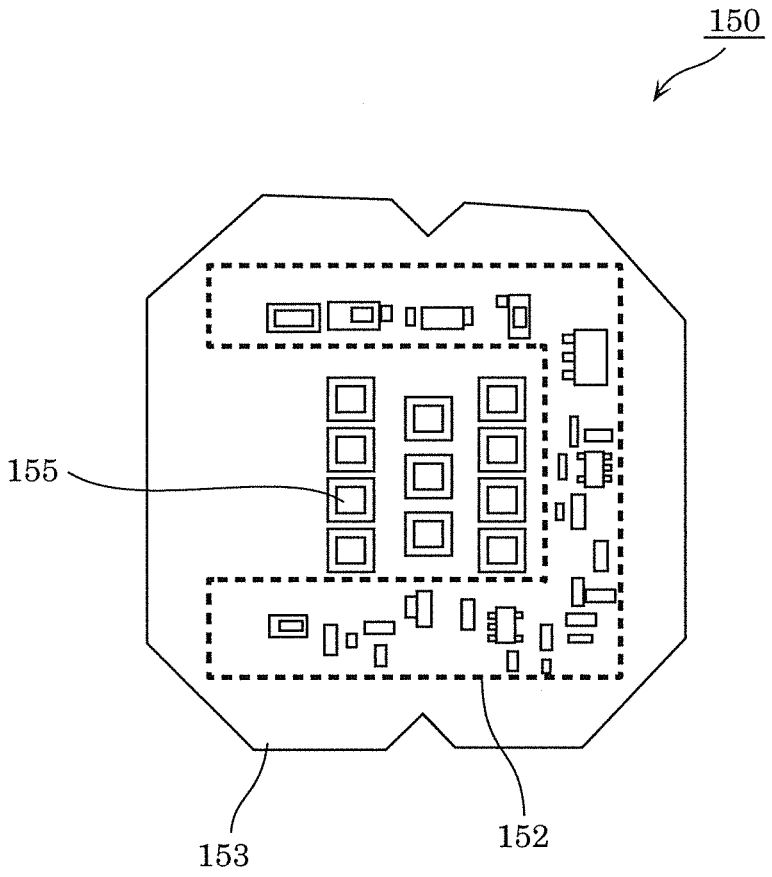
FIG. 10 is a plan view of an appearance of another example of the light-emitting module according to Embodiment 2.

FIG. 10 is a plan view of light-emitting module 150 which alternatively employs SMD 155 (surface mount device) as light-emitting element 102. According to this configuration, light-emitting element 102 and electronic circuit component 152 can be mounted on substrate 153 by the same method, thereby simplifying the fabrication of light-emitting module 150.

[Switching Circuit Block (Emission Control Device)]

Figure 11:
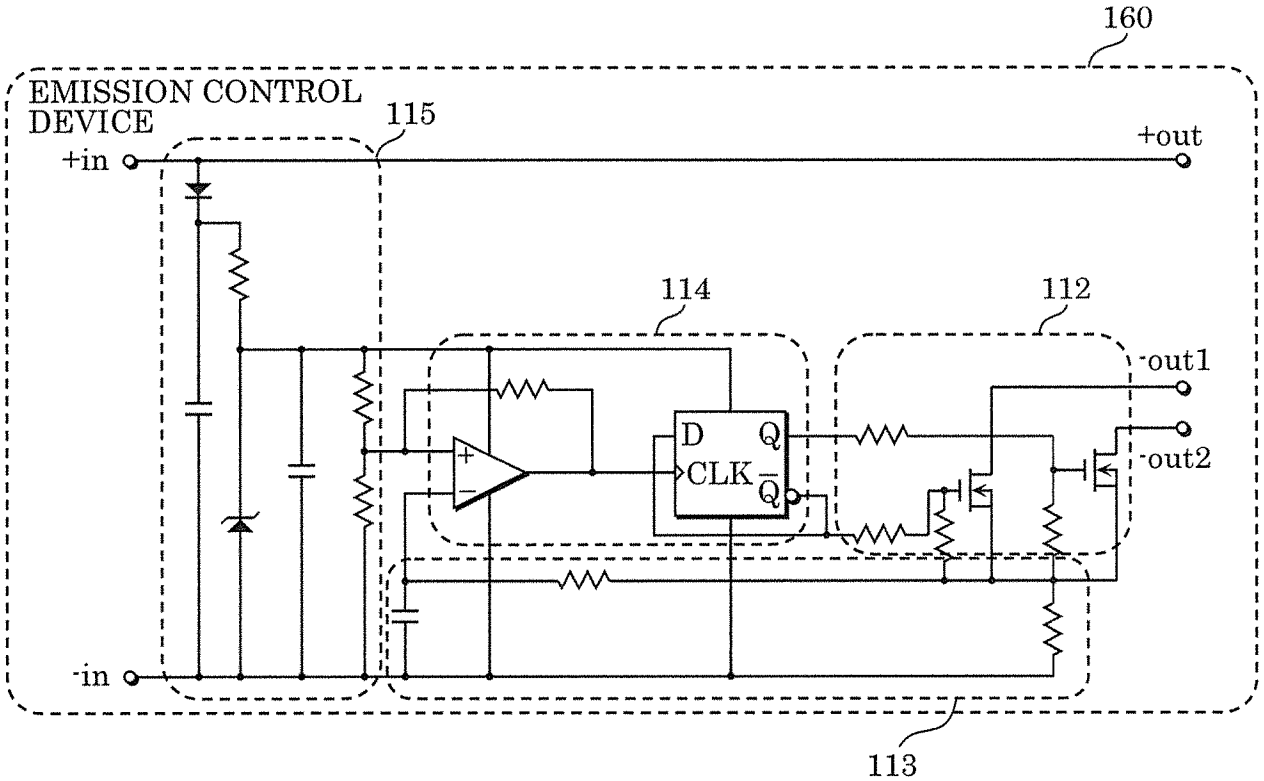
FIG. 11 is a diagram showing a configuration of an emission control device according to Embodiment 2.

The above switching control circuit (switching circuit 112, detection circuit 113, control circuit 114, and controlled power supply circuit 115) may be implemented in a separate circuit block (switching circuit block). FIG. 11 is a diagram showing a configuration of emission control device 160 included in the switching circuit block. In other words, emission control device 160 (switching circuit 112, detection circuit 113, control circuit 114, and controlled power supply circuit 115) is mounted on one substrate 163 that is different from substrates on which light-emitting elements 102 and DC-power supply circuit 111 are mounted.

Emission control device 160 is connected to DC-power supply circuit 111 and has two input terminals (+in, −in) to which power (current and voltage) is supplied from DC-power supply circuit 111 and three output terminals (+out, −out1, −out2) connected to a light source module which includes light-emitting elements 102.

Figure 12:
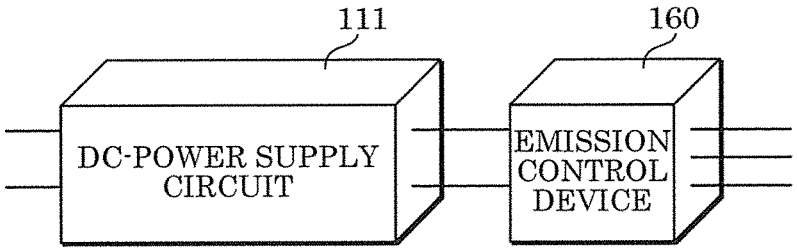
FIG. 12 is a schematic view showing connection of the emission control device according to Embodiment 2.

FIG. 12 is a diagram showing a connection between DC-power supply circuit 111 and emission control device 160 (switching circuit block). As such, providing the switching control circuit as a separate circuit block allows direct use of existing DC-power supply circuit 111, without changing existing DC-power supply circuit 111. Moreover, the light source switching function described above can be added by simply connecting emission control device 160 to an existing lighting fixture.

Figure 13:
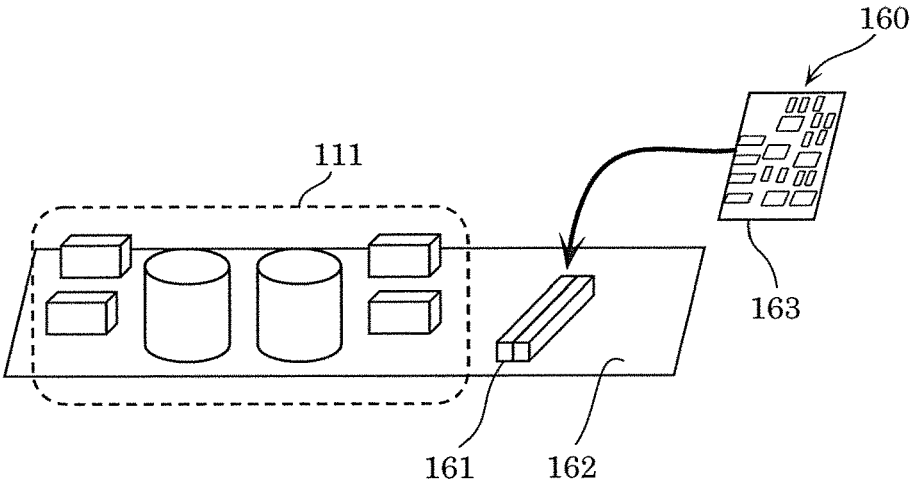
FIG. 13 is a schematic view showing an example of connection of the emission control device according to Embodiment 2.

FIG. 13 is a diagram showing an example of connection between DC-power supply circuit 111 and emission control device 160. For example, as illustrated in FIG. 13, second substrate 163 having emission control device 160 mounted thereon is connected to connection component 161 which is a board-to-board connector on first substrate 162 having DC-power supply circuit 111 mounted thereon.

[Light-Emitting Unit]

Figure 14:
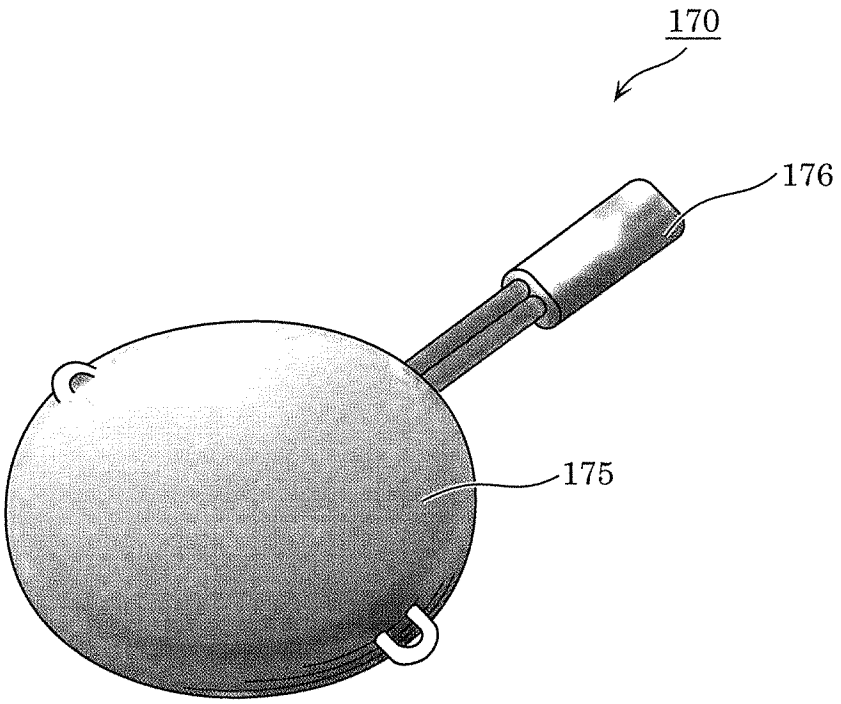
FIG. 14 is a schematic view of an appearance of a light-emitting unit according to Embodiment 2.

Emission control device 160, light-emitting elements 102, and optical members, such as a lens and a reflector, may be integrated. FIG. 14 is a schematic view of an appearance of light-emitting unit 170 which is their integration. As illustrated in FIG. 14, light-emitting unit 170 includes lamp 175 which accommodates emission control device 160 and light-emitting elements 102, and connector 176 connected to DC-power supply circuit 111. Power (current and voltage) is supplied from DC-power supply circuit 111 via connector 176 to emission control device 160 and light-emitting elements.

Figure 15:
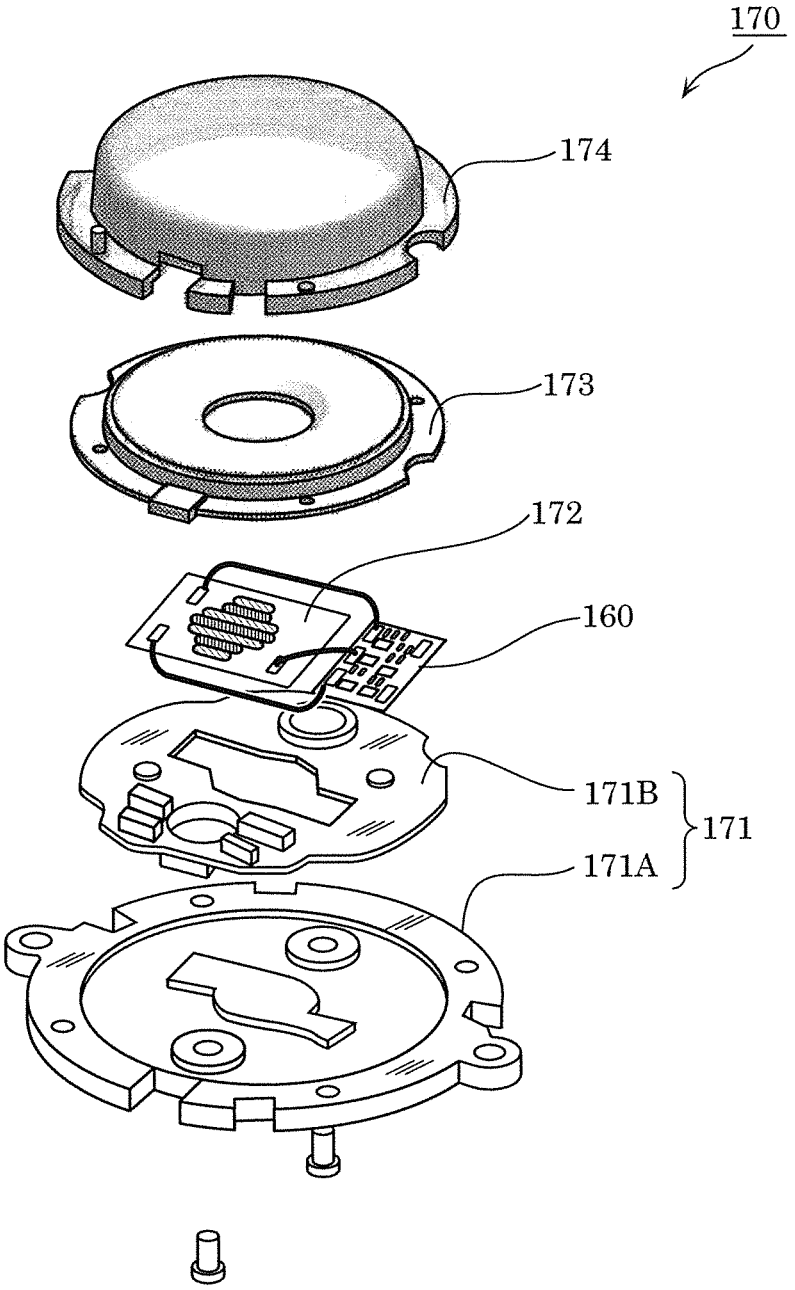
FIG. 15 is an exploded perspective view of the light-emitting unit according to Embodiment 2.

FIG. 15 is an exploded perspective view of light-emitting unit 170. As illustrated in FIG. 15, light-emitting unit 170 includes base member 171, emission control device 160, light source module 172, reflector 173, and lens 174.

Emission control device 160 and light source module 172 are mounted on base member 171. Base member 171 includes mounts 171A and 171B.

Light source module 172 includes light-emitting elements 102 and is connected to emission control device 160. Emission control device 160 is mounted on a substrate different from a substrate on which light source module 172 is mounted.

Reflector 173 and lens 174 are attached to base member 171. Lens 174 is an example of a light-transmissive cover member which covers emission control device 160 and light source module 172. In other words, emission control device 160 and light source module 172 are disposed within lamp 175 configured of base member 171 and the cover member.

In this case also, existing DC-power supply circuit 111 can be used as is. In other words, the light source switching function is switchable between on and off, according to presence or absence of emission control device 160. There is thus no need to use DC-power supply circuit 111 that is dedicated to switch the light sources. Thus, an existing lighting fixture can be readily made to support the light source switching function by replacing an existing light-emitting unit with light-emitting unit 170 which supports the light source switching. In other words, there is no need to change power switch 104 (wall switch) and DC-power supply circuit 111, and thus the addition of the light source switching function can be achieved, without requiring wiring of power switch 104 and DC-power supply circuit 111.

While emission control device 160 and light source module 172 mounted on different substrates are used in FIG. 15, light-emitting module 150 described above may be used.

One Example of Lighting Fixture

Figure 16:
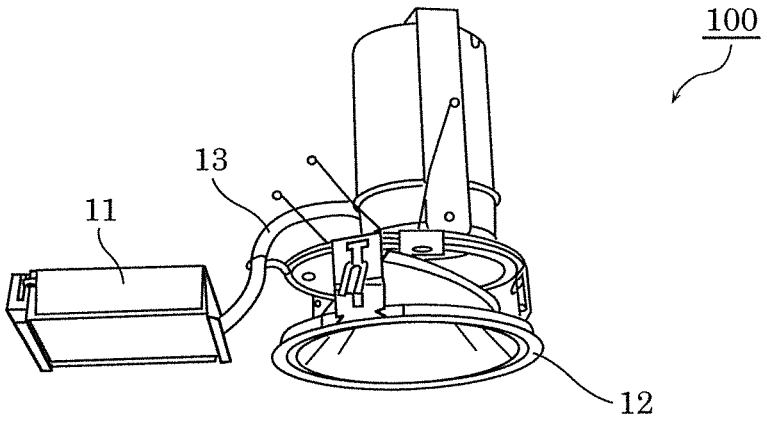
FIG. 16 is a schematic view of an appearance of the lighting fixture according to the embodiment.

FIG. 16 is an external view of lighting fixture 100, etc. described in the above embodiments. FIG. 16 illustrates an example in which lighting fixture 100 is applied to a downlight. Lighting fixture 100 includes circuit box 11, lamp 12, and line 13.

Circuit box 11 accommodates lighting device 101 described above, and an LED (light-emitting elements 102) is attached to lamp 12. Line 13 electrically connects circuit box 11 and lamp 12.

Note that lighting fixture 100 may be applied to other lighting fixtures such as a spot light.

[Other Variations]

DC-power supply circuit 111 may carry out a dimming operation. In other words, DC-power supply circuit 111 may selectively output any of different constant current values.

The light-emitting groups each may include one or more light-emitting elements 102. Moreover, if a light-emitting group includes two or more light-emitting elements 102, light-emitting elements 102 may be connected in series or connected in parallel, or series connection and parallel connection may be combined.

A different light distribution may be produced when a different light-emitting group is selected.

The configuration of detection circuit 113 is not limited to the configuration using resistor R5 as described above. For example, in the case where DC-power supply circuit 111 which carries out the dimming operation is used, the resistance value of resistor R5 needs to be great to detect a small current. For example, detection circuit 113 may further include a diode that is connected to resistor R5 in parallel. This allows detection of small current and also allows a reduction of loss when large current flows through detection circuit 113.

In the above, the configuration of detecting the output current of DC-power supply circuit 111 has been described above. However, output voltage of DC-power supply circuit 111 may be detected. This allows highly accurate detection of a change in voltage, as compared to detecting the voltage by detecting a current as described above.

Control circuit 114 and detection circuit 113 may each be configured of a microcomputer, a field programmable gate array (FPGA), or a programmable logic device (PLD), for example.

The switching elements are not limited to MOSFETs. For example, the switching elements may be bipolar transistors, insulated gate bipolar transistors (IGBT), or relays, for example.

Moreover, at least some of the processing units included in the lighting fixture or the lighting device according to the above embodiments are typically implemented in LSIs which are integrated circuits. These processing units may separately be mounted on one chip, or a part or the whole of the processing units may be mounted on one chip.

Moreover, the divisions of the circuit blocks in the circuit diagrams, etc, are by way of example. Two or more of the circuit blocks may be implemented in one circuit block, one circuit block may be divided into circuit blocks, or part of the functionality of a circuit block may be moved to another circuit block. For example, in FIG. 1, etc., resistors R8 and R9 may be included in comparison circuit 116.

Moreover, the circuitry illustrated in the circuit diagrams above is one example, and the present disclosure is not limited to the above circuitry. In other words, as with the circuitry, circuits which can implement the characteristic features of the present disclosure are also included in the present disclosure. For example, a certain element having an element, such as a switching element (transistor), a resistance element, or a capacitor element, connected thereto in series or in parallel is also included in the present disclosure to an extent that can achieve functionality same as the functionality of the circuitry described above. In other words, "connected" as used in the above embodiments is not limited to two terminals (nodes) being connected directly, and includes the two terminals (nodes) being connected via an element to an extent that can achieve the same functionality.

Moreover, the logic levels represented by high/low or the switching states represented by on/off are illustration for specifically describing the present disclosure. Different combinations of the logic levels or the switching states illustrated can also achieve equivalent result. Furthermore, the configuration of the logic circuit shown above is illustration for specifically describing the present disclosure. A different logic circuit can also achieve an equivalent input and output relation.

While the lighting device and the lighting fixture according to one or more aspects of the present disclosure have been described with reference to the embodiments, the present disclosure is not limited to the embodiments. Various modifications to the embodiments that may be conceived by a person skilled in the art or combinations of the components of different embodiments are intended to be included within the scope of the one or more aspects of the present disclosure, without departing from the spirit of the present disclosure.

What is claimed is:

1. An emission control device configured to be connected to a DC-power supply circuit mounted on a first substrate, and for supplying current from the DC-power supply circuit to a plurality of light-emitting elements when a power switch connected to the DC-power supply circuit is turned on, the emission control device comprising:

a second substrate different from the first substrate, and the following mounted thereon;

a switching circuit for switching which light-emitting element or light-emitting elements from among the plurality of light-emitting elements is supplied with the current;

a detection circuit which detects current or voltage supplied from the DC-power supply circuit; and a control circuit which performs dimming or emission color switching by controlling the switching circuit to switch which of the light-emitting element or light-emitting elements from among the plurality of light-emitting elements is supplied with the current when the power switch is turned from on to off and back to on within a predefined period and the current or the voltage detected by the detection circuit is less than a predetermined reference current or a predetermined reference voltage that is less than a current or a voltage detected by the detection circuit when the power switch is on.

2. The emission control device according to claim 1, wherein the second substrate is different from a substrate on which the plurality of light-emitting elements are mounted.

3. The emission control device according to claim 2, wherein the second substrate is connected to a connection component on the first substrate.

4. A light-emitting module, comprising:

the emission control device according to claim 1; and the plurality of light-emitting elements, the plurality of light-emitting elements being mounted on the second substrate.

5. A light-emitting unit comprising:

the emission control device according to claim 1;

the plurality of light-emitting elements;

a base member on which the emission control device and the plurality of light-emitting elements are mounted; and a light-transmissive cover member which is attached to the base member and covers the emission control device and the plurality of light-emitting elements.

6. A lighting device, comprising:

a DC-power supply circuit;

a plurality of light-emitting elements; and an emission control device configured to be connected to the DC-power supply circuit mounted on a first substrate, and for supplying current from the DC-power supply circuit to the plurality of light-emitting elements when a power switch connected to the DC-power supply circuit is turned on, the emission control device including:

a second substrate different from the first substrate, and the following mounted thereon;

a switching circuit for switching which light-emitting element or light-emitting elements from among the plurality of light-emitting elements is supplied with the current;

a detection circuit which detects current or voltage supplied from the DC-power supply circuit; and a control circuit which performs dimming or emission color switching by controlling the switching circuit to switch which of the light-emitting element or light-emitting elements from among the plurality of light-emitting elements is supplied with the current when the power switch is turned from on to off and back to on within a predefined period and the current or the voltage detected by the detection circuit is less than a predetermined reference current or a predetermined reference voltage that is less than a current or a voltage detected by the detection circuit when the power switch is on.

* * * * *